US005694654A

United States Patent [19]

Roy

[11] Patent Number: 5,694,654

[45] Date of Patent: Dec. 9, 1997

[54] PATIENT LIFTING AND TRANSFER SYSTEM

[76] Inventor: Duane L. Roy, 5520 Monty La., Lolo, Mont. 59847

[21] Appl. No.: 640,496

[22] Filed: May 1, 1996

[51] Int. Cl.[6] ..... A61G 7/10

[52] U.S. Cl. ..... 5/83.1; 5/87.1; 5/89.1

[58] Field of Search ..... 5/81.1 R, 83.1, 5/85.1, 86.1, 87.1, 89.1

[56] References Cited

U.S. PATENT DOCUMENTS

| | | | |
|---|---|---|---|
| 2,050,269 | 8/1936 | Brooks . | |
| 2,272,778 | 2/1942 | Reuter . | |
| 2,368,390 | 1/1945 | Winter . | |
| 2,688,410 | 9/1954 | Nelson . | |
| 2,710,975 | 6/1955 | Stoen et al. . | |
| 3,252,704 | 5/1966 | Wilson | 5/83.1 X |
| 3,739,772 | 6/1973 | Ennis | 128/80 |
| 3,999,228 | 12/1976 | Thomas | 5/83.1 |
| 4,003,479 | 1/1977 | Reyer | 214/1 D |
| 4,221,011 | 9/1980 | Flinchbaugh | 5/89 |
| 4,243,147 | 1/1981 | Twithchell et al. | 5/89.1 X |
| 4,372,452 | 2/1983 | McCord | 212/159 |
| 4,446,587 | 5/1984 | Jump | 5/883 |
| 4,530,122 | 7/1985 | Sanders et al. | 5/83 |
| 4,571,758 | 2/1986 | Samuelsson | 5/83.1 |
| 4,627,119 | 12/1986 | Hachey et al. | 5/83 |
| 4,739,526 | 4/1988 | Hollick | 5/83 |
| 4,882,798 | 11/1989 | Worsnop | 5/89 |
| 4,903,355 | 2/1990 | Hickerson | 5/89 |
| 4,944,056 | 7/1990 | Schroeder et al. | 5/85.1 |
| 5,072,840 | 12/1991 | Asakawa et al. | 212/205 |
| 5,077,844 | 1/1992 | Twitchell et al. | 5/87.1 |
| 5,337,908 | 8/1994 | Beck, Jr. | 212/189 |
| 5,406,658 | 4/1995 | Olkkonen et al. | 5/87.1 X |
| 5,456,655 | 10/1995 | Morris | 5/85.1 X |
| 5,511,256 | 4/1996 | Capaldi | 5/89.1 X |

FOREIGN PATENT DOCUMENTS

| | | |
|---|---|---|
| 1046202 | 1/1979 | Canada . |
| 197805 | 3/1978 | Germany . |
| 950017 | 2/1964 | United Kingdom . |
| WO 84/02074 | 6/1984 | WIPO . |

OTHER PUBLICATIONS

Guldmann "Lifting Slings", 8 page Brochure.

Guldmann "Dan-Hoist 3 Ceiling-mounted Hoist", 2 page Brochure.

Guldmann "Lifting Hanger for Guldmann Hoists", 2 page Brochure.

Guldmann "Quality Rehabilitation and Nursing Products for Patients and Those Who Care",8 page Brochure.

Guldman "Bath Stretcher for Lifting in Swimming Pools", 2 page Brochure.

Handi Move "Now, Handi-Move Makes it Quick and Easy to Transfer", 8 page Brochure.

*Primary Examiner*—Michael F. Trettel

*Attorney, Agent, or Firm*—Harry M. Cross, Jr.

[57] ABSTRACT

A lifting and transferring system for lifting a person and transferring the person from one location to another location comprises a lifting and transferring assembly and a transfer apparatus. The lifting and transferring assembly comprises a lifting arm assembly and a support, the lifting arm assembly providing a lifting arm rotatable about a vertical axis. A mounting rotatably mounts the lifting arm to the support so that the lifting arm cantilevers from the mounting. An extendable and retractable lifting cable depends from an outer end of the lifting arm. A first motor is provided for rotating the lifting arm. A second motor is provided for extending and retracting the lifting cable. A controller is provided to operate the first and second motor. The transfer apparatus is connectable to the lifting cable and arranged to support the person during operation of the lifting and transferring assembly.

19 Claims, 8 Drawing Sheets

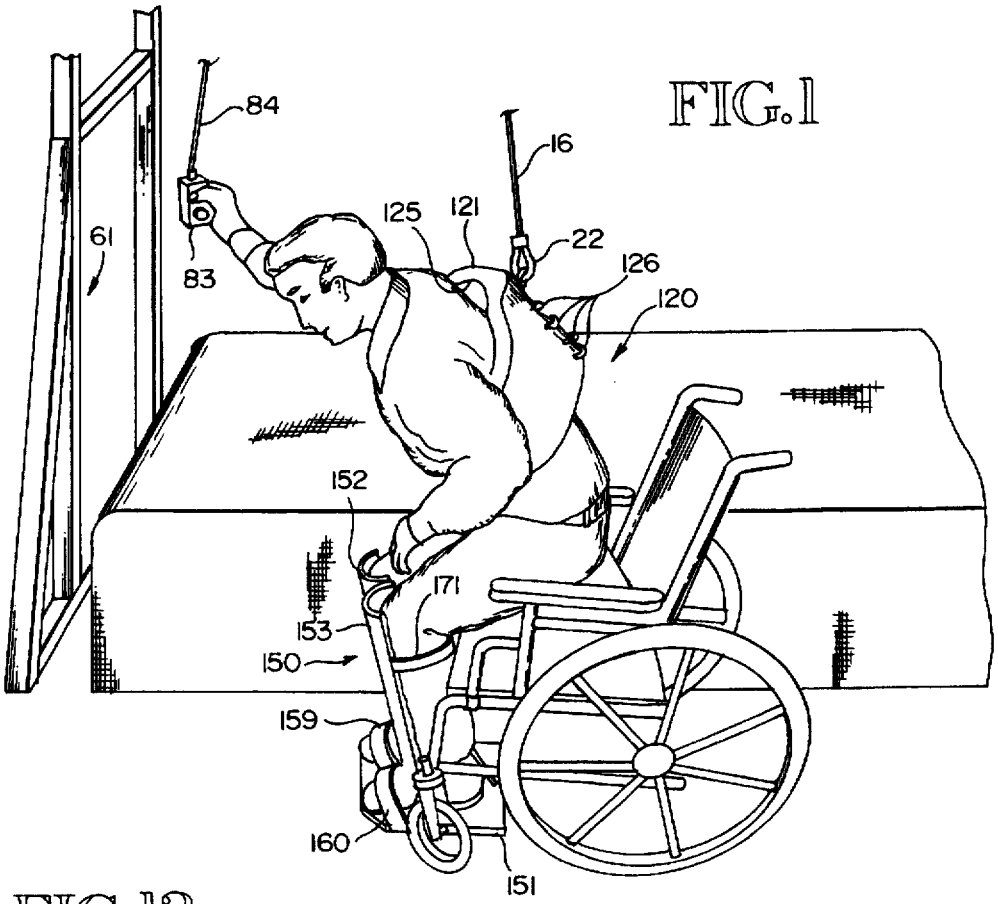
FIG. 1
FIG. 12
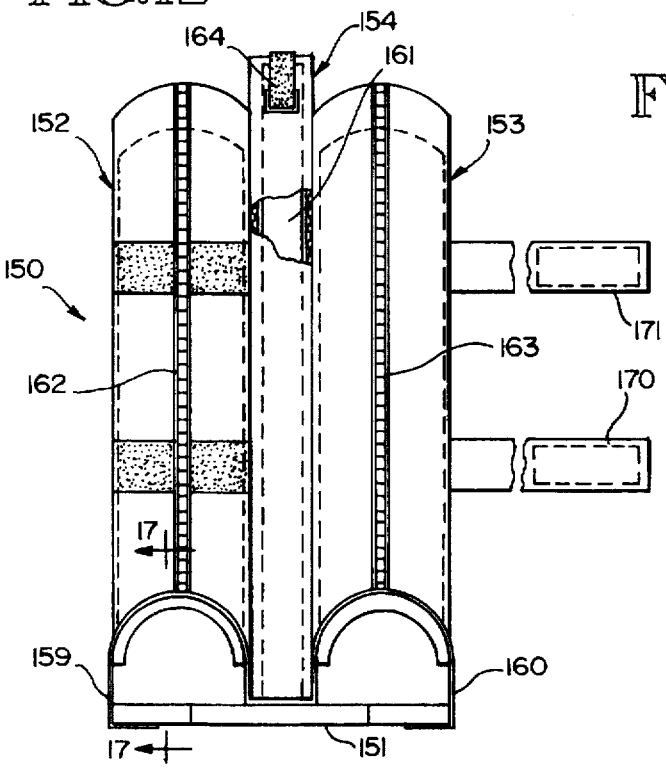
FIG. 13
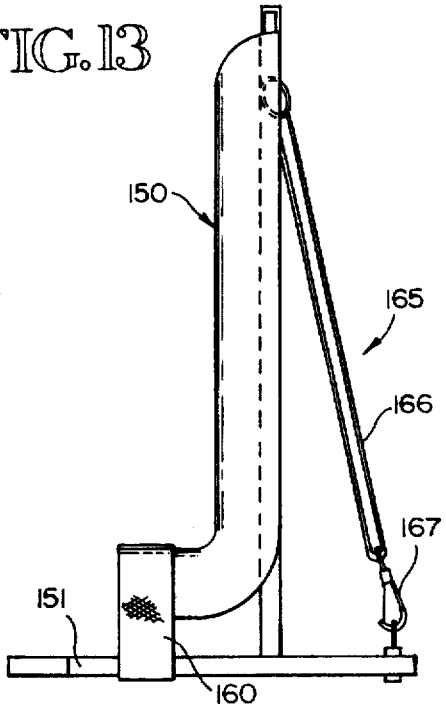

FIG. 4
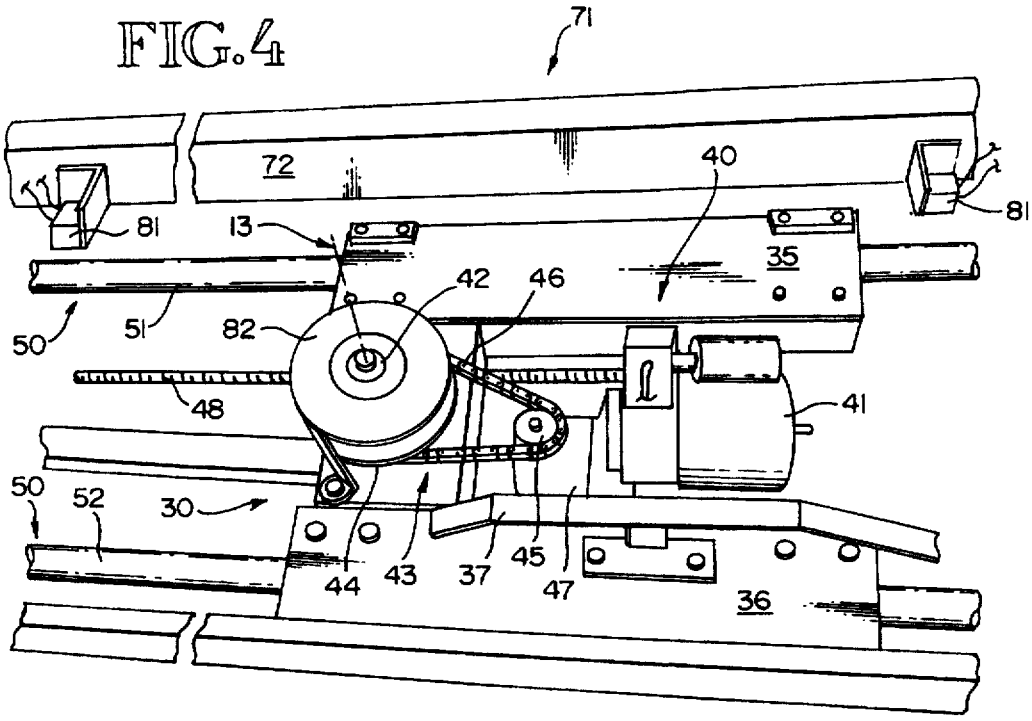
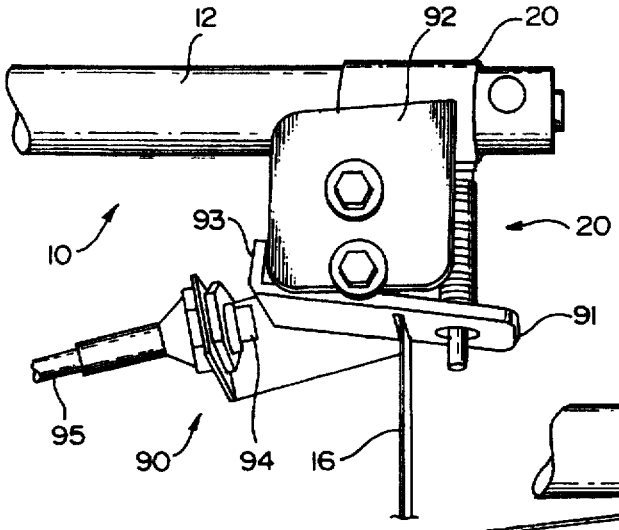
FIG. 5
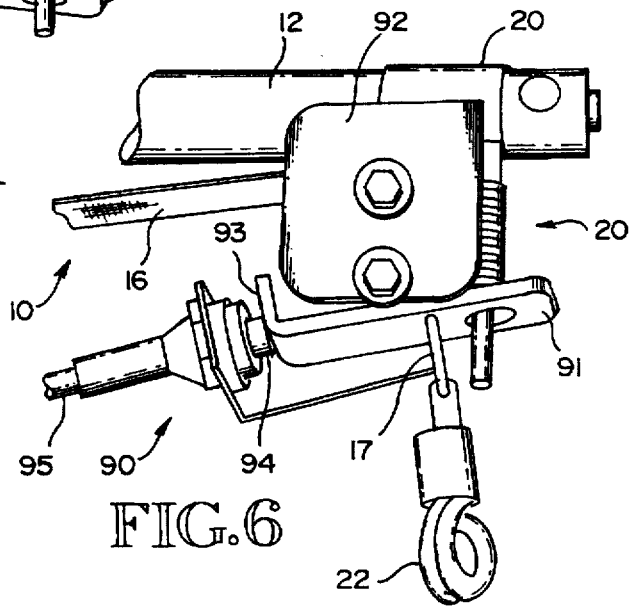
FIG. 6

FIG. 8
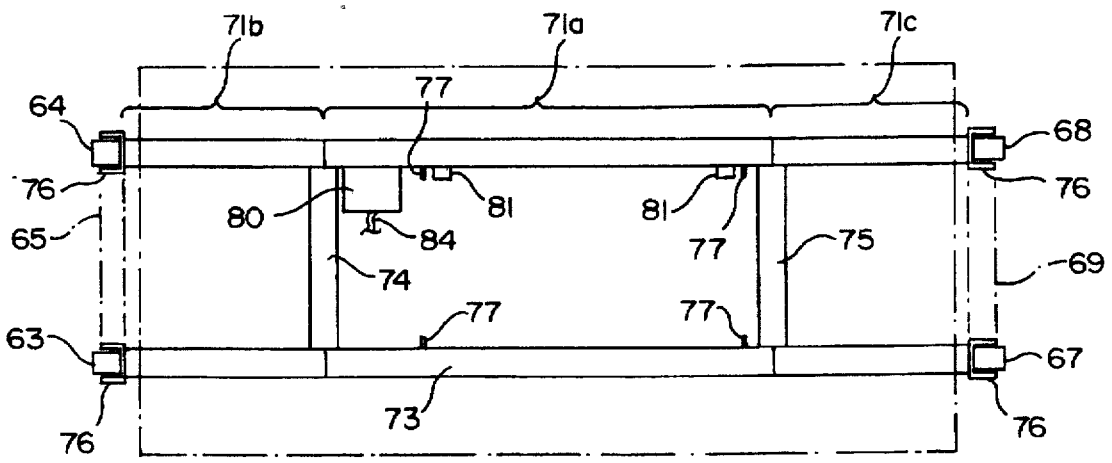
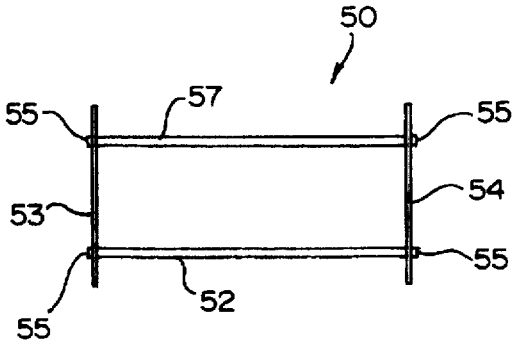
FIG. 9

PATIENT LIFTING AND TRANSFER SYSTEM

BACKGROUND OF THE INVENTION

1. Field of the Invention

This invention relates to patient lifting or hoist systems for lifting and transferring patients. More particularly, this invention relates to such systems designed to straddle a bed for lifting patients into and out of bed.

2. Brief Description of the Prior Art

Lifting or hoist systems for lifting and transferring patients into and out of bed have been proposed heretofore. Some such systems are designed to be installed permanently in facilities such as hospitals and nursing homes. Some such systems are designed for portable use so that they may be moved about within a room. However, such systems as have been heretofore proposed have not been successfully introduced into home-care situations where a disabled person is cared for at home. Moreover, the systems that have been proposed for portable use have suffered from a number of deficiencies, ranging from being too expensive, too cumbersome to install or use, too bulky to be accommodated in normal-sized rooms, or too structurally or functionally limited to handle patients in a variety of positions or situations.

People can become disabled as a result of injury or illness. They can be partially or fully disabled insofar as concerns taking care of their own needs. In many situations, particularly involving elderly persons, disabled people are required to be cared for in nursing home environments because home-care facilities and family members are unable to provide the necessary patient lifting and transferring capability required. For example, elderly stroke victims may only be partially paralyzed and capable, with some assistance, of moving about to take care of their own needs. Such needs would include getting into and out of bed, getting into and out of a wheelchair, getting in and out of a portable commode, and so forth. A partially disabled person, such as an elderly stroke victim, may be able to steady himself or herself, but require lifting from a prone to a sitting position in bed, and also require lifting from a bed into a wheel chair or onto a portable commode, and vice versa. Family members may not be able to provide the lifting and transferring capability required to assist the partially disabled person in these functions. Such problems are only magnified where a patient is substantially or completely disabled. At the present time, there does not appear to be a satisfactory patient lifting and transferring system that would offer a home-care alternative to nursing home care for such people. The consequent economic and emotional hardships that the patient and family members must endure, because the patient cannot be cared for at home, are extreme. The cost of nursing home care is exorbitant and often substantially depletes a patient's financial resources. Nursing home patients and family members often suffer emotionally because of the physical separation and because of the inability to help in care-giving.

SUMMARY OF THE INVENTION

It is a primary object of this invention to provide a patient lifting and transfer system that can be installed in a patient's home and operated by the patient or by the patient's family members. It is another object to provide such a system that is portable and can be installed and removed conveniently. It is a further object to provide such a system that can be used to provide a variety of lifting and transferring functions required by a disabled person. It is still another object to provide such a system that is structurally and functionally suitable for use in hospital and nursing home environments, in addition to home-care environments. These and other objects and advantages will become apparent from the following description.

In accordance with these objectives, the present invention comprises a lifting and transferring system for lifting a person and transferring the person from one location to another location. The system comprises a lifting and transferring assembly and a transfer apparatus. The lifting and transferring assembly comprises a lifting arm assembly and a support, the lifting arm assembly providing a lifting arm rotatable about a vertical axis. A mounting rotatably mounts the lifting arm to the support so that the lifting arm cantilevers from the mounting. An extendable and retractable lifting cable depends from an outer end of the lifting arm. A first motor is provided for rotating the lifting arm. A second motor is provided for extending and retracting the lifting cable. A controller is provided to operate the first and second motor. The transfer apparatus is connectable to the lifting cable and arranged to support the person during operation of the lifting and transferring assembly. The transfer apparatus may comprise a vest fittable around the person's torso and detachably connectable to the lifting cable, and a foot and leg support fittable around the person's lower legs and detachably connectable to said vest.

BRIEF DESCRIPTION OF THE DRAWINGS

FIG. 1 is a partial view in perspective of a person being lifted into or out of a wheelchair next to a bed illustrating the application of the vest and leg assemblies of this invention to a person;

FIG. 4 is a partial enlarged view in perspective of the FIG. 2 assembly illustrating the carriage and track assemblies of the system;

FIG. 5 is a partial enlarged view in perspective of a portion of the lifting assembly of the system in one mode of operation;

FIG. 6 is similar to FIG. 5 but illustrates another mode of operation of the lifting assembly;

FIG. 8 is a plan view of the support assembly of the system;

FIG. 9 is a plan view of the track assembly of the system;

FIG. 12 is a front elevation view of the leg assembly of the system;

FIG. 13 is a side elevation view of the FIG. 12 leg assembly;

DESCRIPTION OF THE PREFERRED EMBODIMENT

Figure 2:
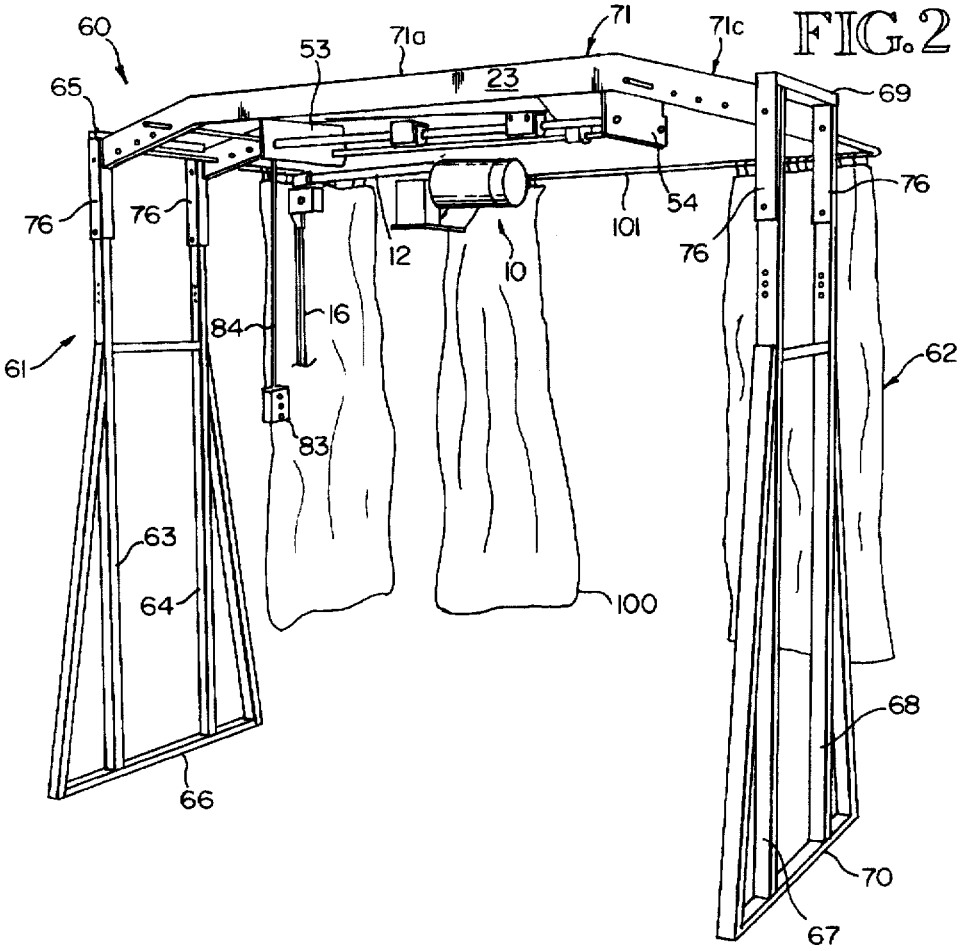
FIG. 2 is a perspective view of the lifting and transferring assembly of the system.
Figure 3:
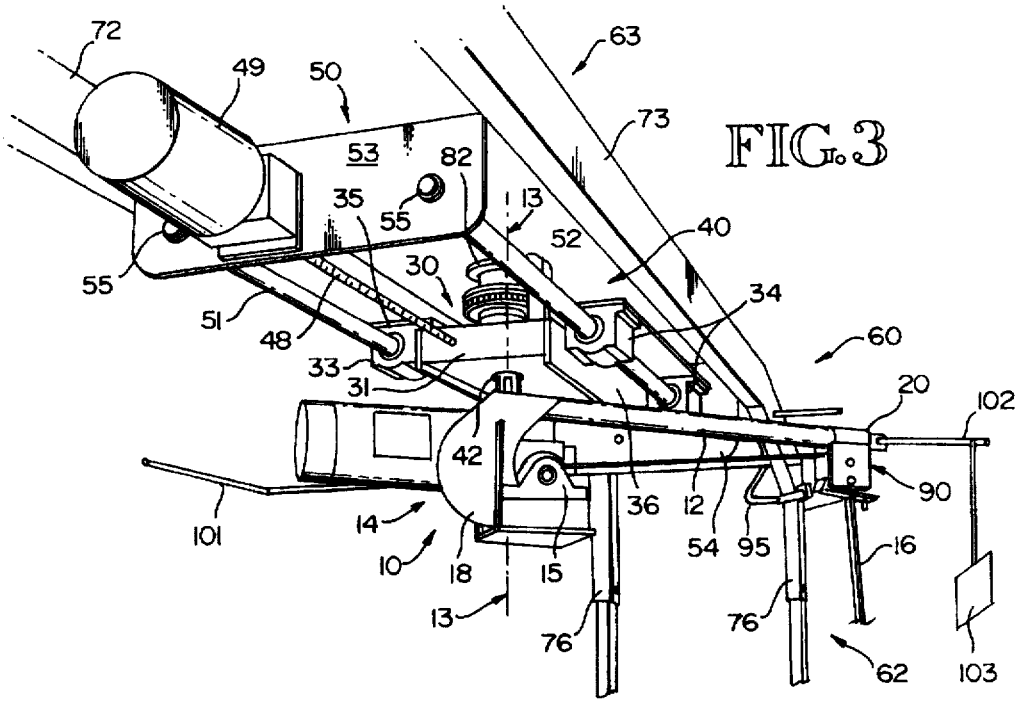
FIG. 3 is partial enlarged view in perspective of the FIG. 2 assembly illustrating the lifting and carriage assemblies of the system.
Figure 7:
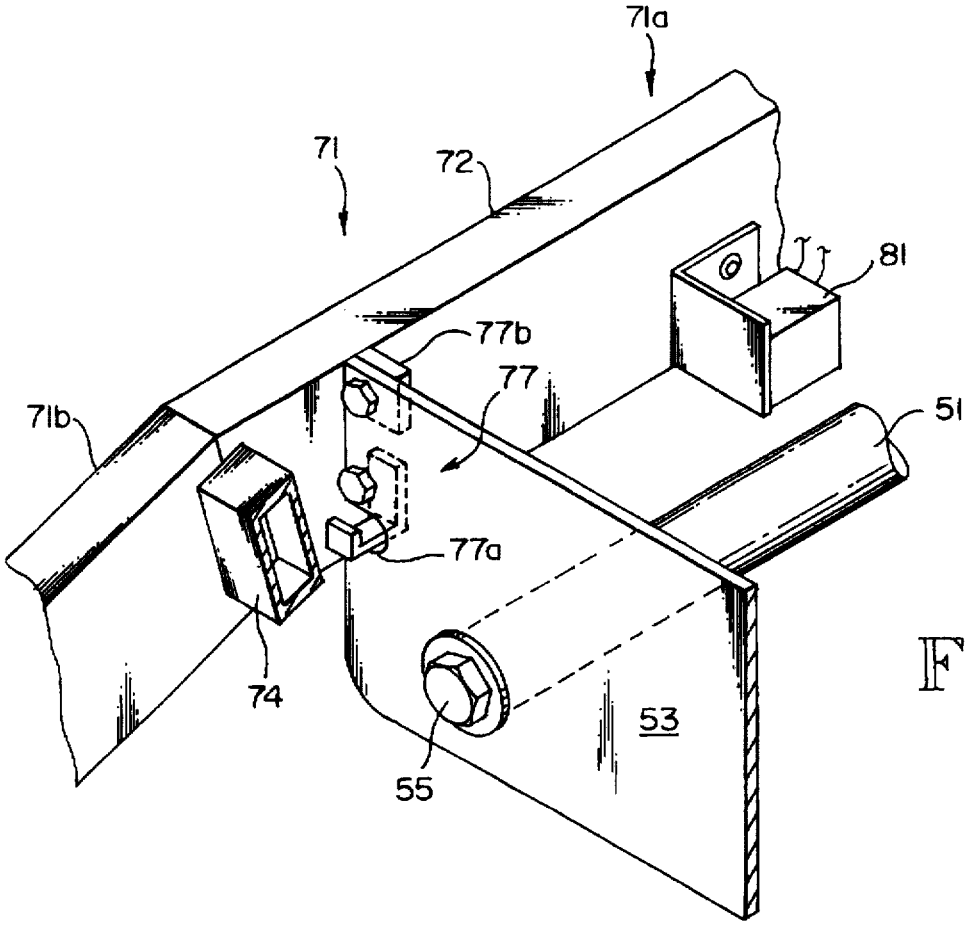
FIG. 7 is a detail view in perspective of the track and support assemblies of the system.
Figure 10:
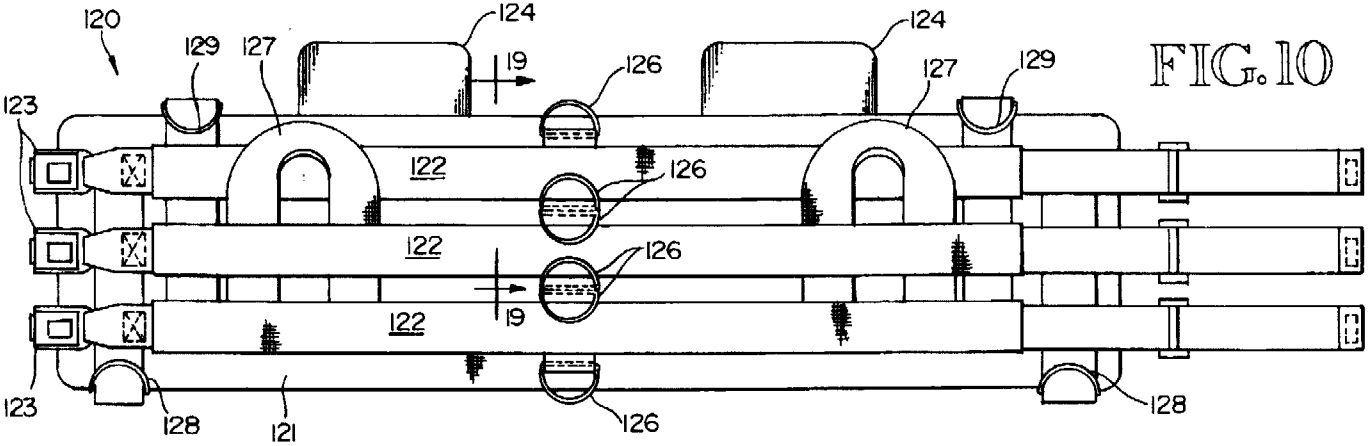
FIG. 10 is a vertical elevation view of the vest assembly of the system.
Figure 19:
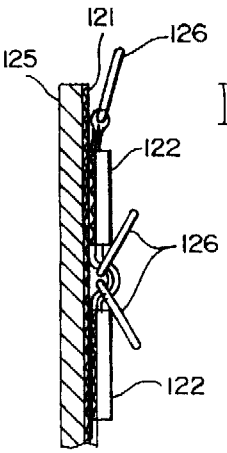
FIG. 19 is a partial cross-sectional view taken along the line 19—19 in FIG. 10.
Figure 11:
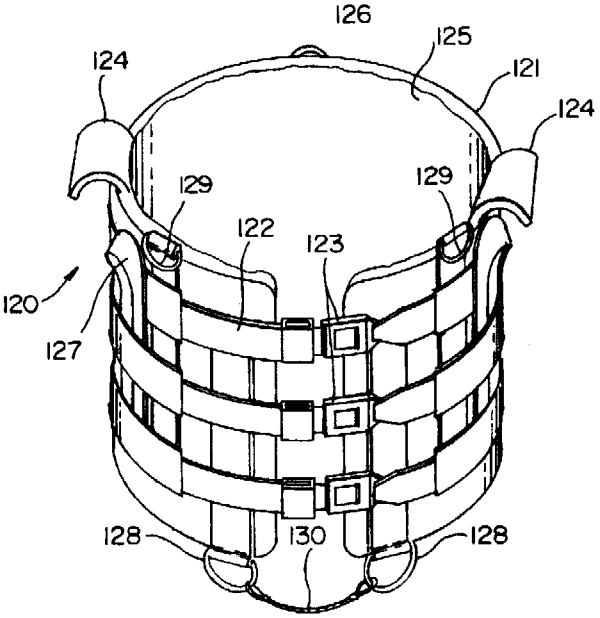
FIG. 11 is a perspective view of the FIG. 1 vest assembly connected together.
Figure 14:
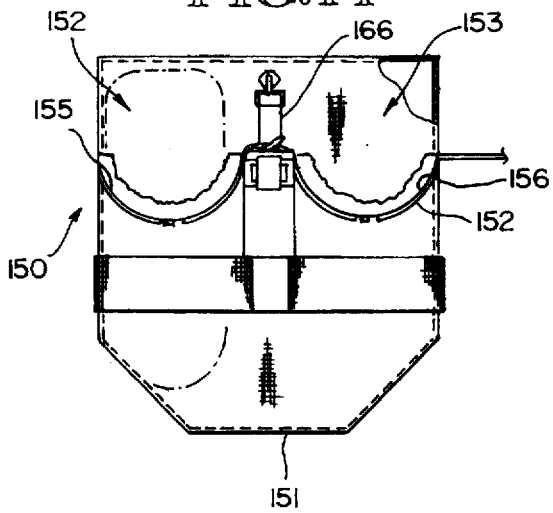
FIG. 14 is a top plan view of the FIG. 12 leg assembly.
Figure 15:
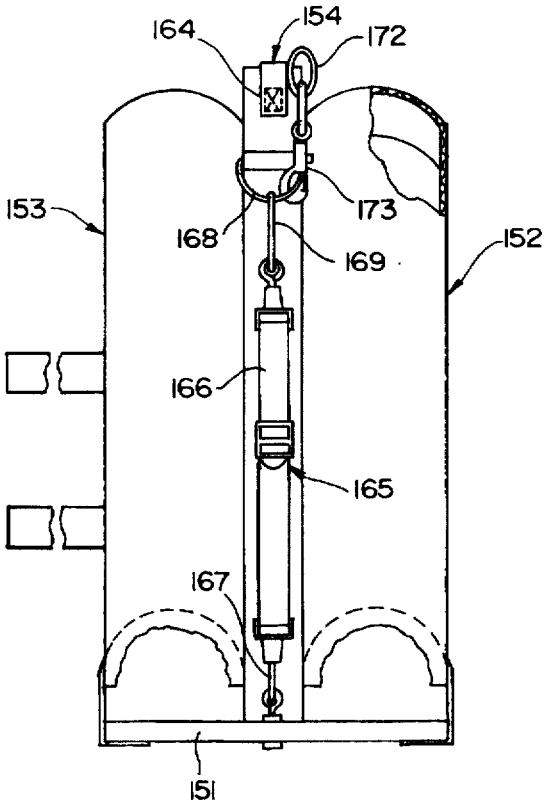
FIG. 15 is a rear elevation view of the FIG. 12 leg assembly.
Figure 16:
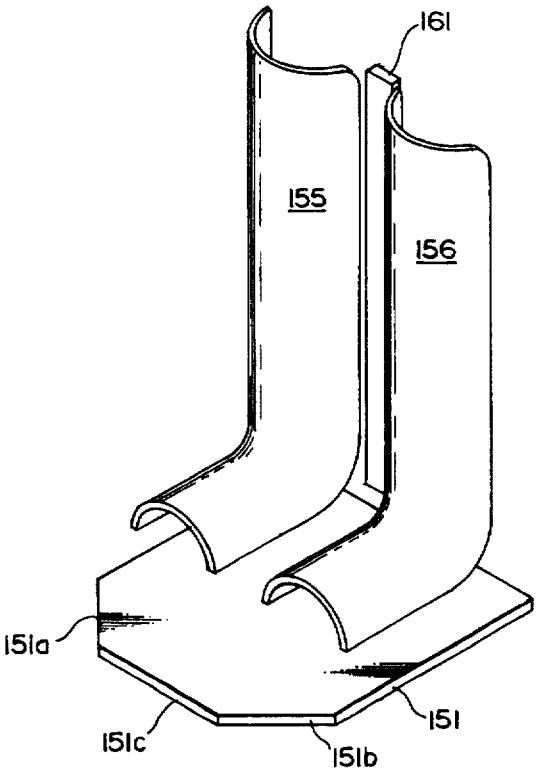
FIG. 16 is a front perspective view of internal components of the FIG. 12 leg assembly.
Figure 17:
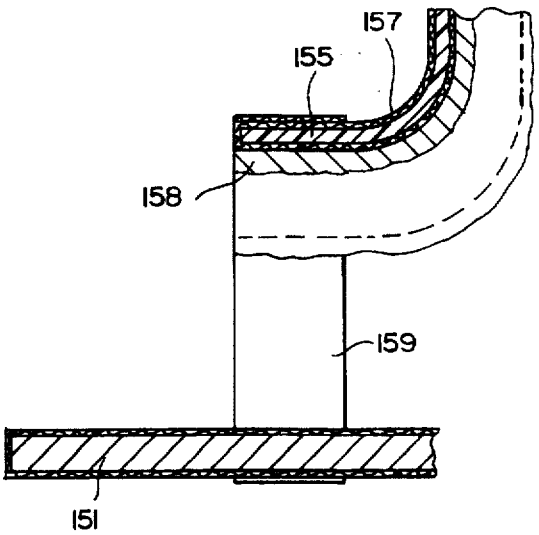
FIG. 17 is a partial cross-sectional view taken along the line 17—17 in FIG. 12.
Figure 18:
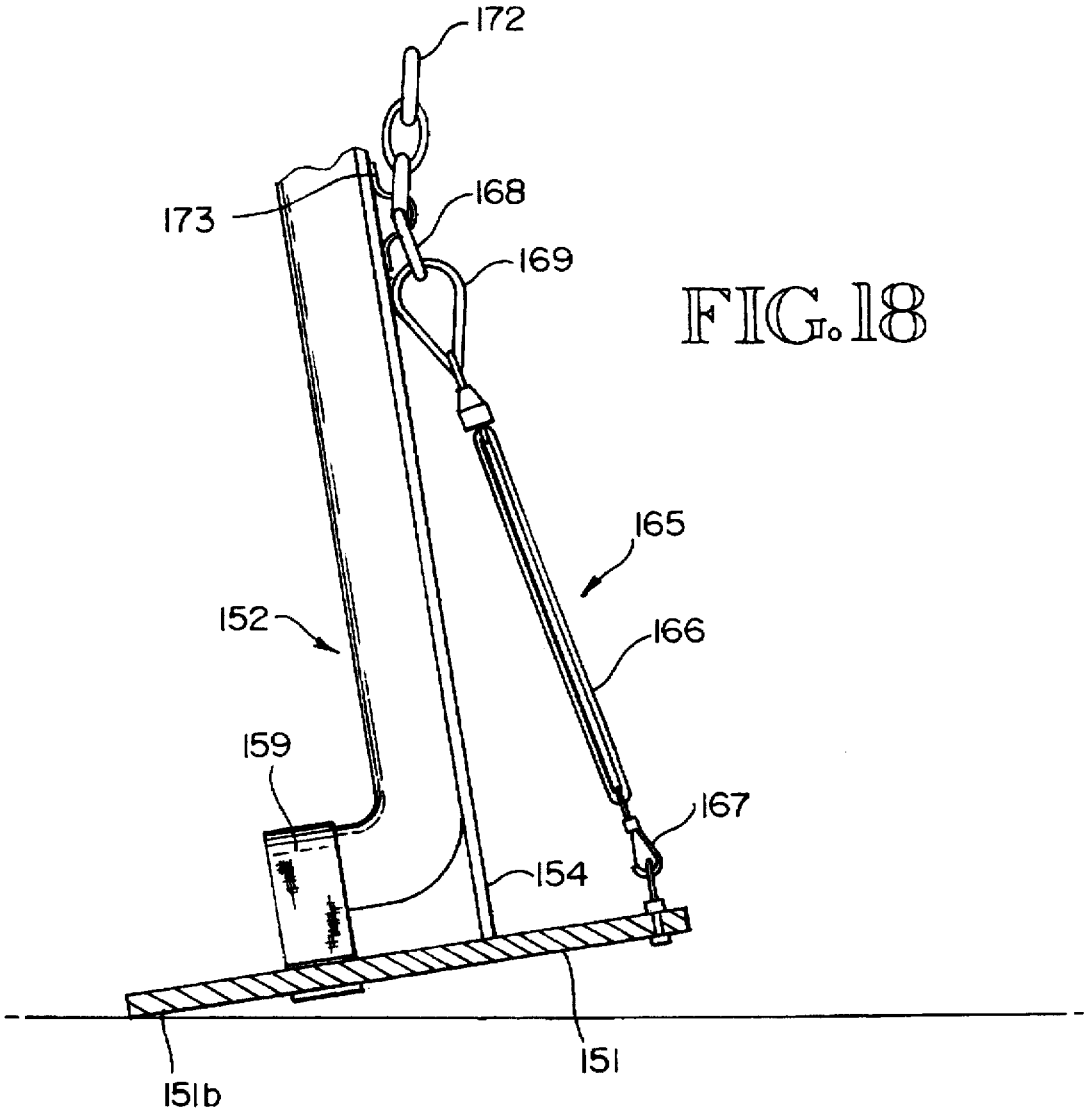
FIG. 18 is side elevation view of the FIG. 12 leg assembly as it would appear attached to the vest assembly of FIG. 11.

The system of the present invention comprises a lifting and transferring assembly designed to lift and transfer a patient from one position to another, and a vest and leg assembly designed to be applied to a patient and used in conjunction with the lifting and transferring assembly to lift and transfer the patient. The lifting and transferring assembly comprises a lifting assembly 10, a carriage assembly 30, a drive assembly 40, a track assembly 50, support assembly 60, and an electrical or electronic control assembly. The vest and leg assembly comprises a vest assembly 120 and a leg assembly 150. The lifting and transferring assembly is shown in FIGS. 2–9, and partially in FIG. 1 as well. The vest assembly is shown in FIGS. 1 and 10–11 and 19. The leg assembly is shown in FIGS. 1 and 12–18.

LIFTING AND TRANSFERRING ASSEMBLY

The lifting assembly 10 includes a lifting arm 12 rotatable about a vertical axis 13, and a winch 14 associated with the lifting arm 12 for raising and lowering a lifting cable 16 that is extended from the lifting arm 12. The lifting cable 16 can be provided in any suitable configuration, such as a braided wire or a strap, so long as it is strong enough to raise and lower a person weighing up to several hundred pounds; a strap configuration being preferred. As seen in the drawings, the winch 14 and lifting arm 12 are joined by a mounting bracket 18, the lifting arm 12 projecting from the mounting bracket 18 in cantilevered fashion, and the winch 14 being carried by the mounting bracket 18. The mounting bracket 18 is rotatably-mounted to revolve around axis 13 and, consequently, the lifting arm 12 and the winch 14 will revolve together as a unit when the mounting bracket 18 revolves around axis 13. The winch 14 includes a cable reel 15 about which the cable 16 is wound for extension and retraction. The outer end of the lifting arm 12 is fitted with a fairlead 20 and the cable 16 is extended from the cable reel 15 along the length of the lifting arm 12 and out through the fairlead 20. The end of the cable 16 is fitted with an appropriate connector 22 for use in attaching the cable to the person to be lifted or transferred.

The lifting assembly 10, through mounting bracket 18, is rotatably-mounted to an overhead platform 31 so that the rotation axis 13 extends vertically through the platform 31. A drive assembly 40 is carried by the platform 30 and comprises a drive motor 41 that is drivingly connected to a drive shaft 42. The drive shaft 42 is rotatably mounted by the platform 31 and connected to the mounting bracket 18 so that operation of drive motor 41 will rotate the lifting assembly 10. As seen in the drawings, drive assembly 40 includes a drive train 43 in the form of a chain sprocket 44 mounted to the upper end of drive shaft 41, a chain sprocket 45 mounted to the output shaft of a right angle gear drive 47, and a drive chain 46 connecting the two sprockets. Drive train 43 constitutes a right angle speed-reducing drive train that converts the rotary output of drive motor 41 from a horizontal axis to the vertical axis 13 and converts the relatively high RPM output of drive motor 41 to a much lower RPM input to drive shaft 42.

As seen in the drawings, platform 31 is part of a carriage assembly 30. Carriage assembly 30 is designed to move back and forth along a track assembly 50 in a horizontal plane so that the lifting cable 16 of lifting assembly 10 can be longitudinally positioned, relative to the longitudinal orientation of the track assembly 50, wherever necessary to accomplish a lifting task. The track assembly 50 includes a pair of elongated parallel rails 51, 52 that define the longitudinal orientation of the track assembly 50. The carriage assembly 30 includes two sets of rail mounts 33, 34 that mount the platform 31 to the rails 51, 52. Rail mount sets 33, 34 and rails 51, 52 must be joined in a manner that enables the platform 31 to be moved along the track assembly 50. Rail mount sets 33, 34 and rails 51, 52 also must be joined in a manner that will maintain the platform 31 in a stable plane under diverse forces to which the platform 31 will be subjected.

Because the lifting cable 16 can be positioned at different perimeter locations with respect to the platform 31, the downward force exerted through cable 16 when a patient is lifted, can result in downward reaction forces on one or both rail mount sets 33, 34 as well as upward reaction forces on one or both rail mount sets. Therefore, the interrelationship of the rail mount sets 33, 34 and the rails 51, 52 must maintain the platform 31 in a stable plane and prevent the platform from tipping or tilting to either side or to either end. This interrelationship requires the rail mount sets 33, 34 to be able to maintain the stability of the platform 31 against both upward and downward forces and to prevent the platform from tilting from side to side or end to end, and from racking or twisting in the plane of the rails 51, 52, so that movement of the platform along the track assembly 50 will not be impeded.

The force exerted through lifting cable 16 must also be resisted by the track assembly 50 so that the rails 51, 52 will not be racked or twisted out of alignment due to any racking or twisting force exerted on the rails through platform 31 and the rail mount sets 33, 34. The drawings show a preferred rail construction, each rail 51, 52 comprising a solid steel shaft that extends over the full length of required travel for the platform 31. The track assembly 50 includes steel end bars 53, 54 in the form of rectangular plates that are rigidly attached to the ends of the rails 51, 52. The ends of rails 51, 52 are bored and threaded to match bores through the end bars 53, 54 and fastening machine screws 55 are extended through the end bars and threaded into the threaded bores in the ends of rails 51, 52 as shown. The structural combination of end bars 53, 54 and rails 51, 52 is rigid so that rails 51, 52 will remain parallel and coplaner, and will not rack or twist.

Each rail mount set 33, 34 must engage its respective rail 51 or 52 over a length sufficient to hold the platform 31 true with respect to the longitudinal extent of the rails. A preferred configuration for each rail mount set 33, 34 provides a pair of rail mount bearing blocks. Each bearing block is provided with a cylindrical bearing cavity that encircles one of the rails in a close tolerance fit that permits the bearing blocks to slide on the rail. Furthermore, the bearing blocks of each rail mount set are aligned and fastened to a mounting plate 35, 36, each mounting plate being fastened, as by welding, to one of the side of the platform 31 with the plates 35, 36 parallel. A preferred construction for the mounting plates 35, 36, that ensures that the platform and mounting plate combination will be sufficiently strong and stiff, is to provide the mounting plates as steel angles oriented so that they each have a vertical side fastened to the platform 31 and a horizontal side fastened to the bearing block pairs of one of the rail mount sets 33, 34. In this construction, the horizontal sides of the steel angle plates 35, 36 would project outwardly, away from the platform 31, to either overlay or underlay the rails 51, 52. The bearing blocks could be mounted either on the bottom or top horizontal surfaces of the steel angle plates' horizontal sides, depending on whether the desired construction located the horizontal angle plate sides above or below the rails 51, 52. The drawings shown the bearing blocks mounted to the bottom surfaces of the steel angle plates' horizontal sides.

The drawings show the bearing blocks of the rail mount sets 33, 34 as each having a cylindrical cavity machined in a steel block, the block being further machined to provide mounting lugs for fastening the block to an angle plate 35, 36 by welding, or machine screw or machine bolt fasteners. In order to install the bearing blocks of this configuration to the rails 51, 52, the rails must be capable of being inserted through the bearing block cavities. Therefore, the rails 51, 52 should be detachable from one or both end mounting bars 53, 54. If the rail mount sets 33, 34 are provided in a configuration such that they may be assembled around the rails, the rails could be permanently attached to the end mounting bars 53, 54 before installation of the rail mount sets.

As shown in the drawings, the platform 31 may be fabricated from a steel tube or rectangular cross-section, the ends of the tube being closed by the steel angle plates 35, 36. In order to keep the vertical profile of the carriage assembly 30 reasonably low, the drive motor 41 is preferably located adjacent one end of the platform 31. This may be accomplished, as shown in the drawings, by welding a steel motor mount plate 37 to one end of the platform 31 so that plate 37 projects longitudinally a sufficient distance to provide a mounting for motor 41. To maintain the desired low vertical profile, the motor 41 is mounted horizontally so that its output axis is horizontal, necessitating the provision of right angle gear drive 47 coupled to the output shaft of motor 41 to provide a vertical output axis for sprocket 45. Right angle gear drive 47 is fastened directly to the housing of motor 41 by machine screws or machine bolts so that motor 41 projects from drive 47, and the housing of gear drive 47 is the unit that is actually fastened to mount plate 37 by machine screws or machine bolts.

Drive assembly 40 also includes an acme screw drive consisting of an acme screw 48 rotatably mounted in a bearing located in end bar 53, and a screw drive motor 49 mounted to and outwardly from one of the end bars 53, 54. Acme screw 48 extends from one end bar 53 through a threaded bearing in platform 31 and projects from the opposite end of platform 31. Acme screw 48 is coupled to screw drive motor 49. Acme screw 48 is driven by screw drive motor 49 and, as the screw rotates, drives platform 31 back and forth along rails 51, 52.

As shown in the drawings, a support assembly 60 is provided in a configuration that is designed to straddle a bed from one end to the other. The support assembly 60 as shown comprises a pair of end supports 61, 62 and an overhead support 71. The overhead support 71 is designed to be detachably fastened to the end supports 61, 62 so that the three support components can be brought into a room in a disassembled condition and assembled on site, and so that the three support components can be disassembled on site and then removed from the room. Each of the three components, 61, 62 and 71 are constructed so as to stably withstand the loads to which the system will be subjected without having to be secured or anchored to any other structure.

Both the end supports 61, 62 and the overhead support 71 can be fabricated from rectangular steel tubes that are welded together to provide the configuration shown in the drawings. Overhead support 71, for example, can be composed of tubular steel side members 72, 73 that are generally aligned parallel to one another, and end cross members 74, 75 could be welded to the ends of side members 72, 73 to maintain that alignment. Likewise, each end support 61, 62 can be composed of vertical tubular steel side members 63, 64, 67, 68 that are generally aligned parallel to one another, and top and bottom end cross members 65, 66, 69, 70 could be welded to the top and bottom ends of side members 63, 64, 67, 68 to maintain that alignment.

Each end of the overhead support side members 72, 73 is provided with leg connectors in the form of vertical steel channels 76. The bases of channels 76 are welded to the support side member ends so that the channels open outward. The channels depend downward from the ends of the overhead support side member. The channel sides of channels 76 are bored to provide bolt holes for fastening such as machine bolts. The upper end portion of each end support side member 63, 64, 67, 68 is provided with matching bore holes so that the channels 76 can be fitted over the upper end portions of the end support members and fastened thereto. The channels 76 open outward and are open at the top and bottom. Therefore, the end supports 61, 62 can be located outward of the channels 76 and brought inward, toward one another, so that the end support side members can be inserted into the channels 76 for attachment thereto. The end support side members may be provided with more than one set of bores so that the vertical location of the overhead support can be set at different elevations relative to the upper end portions of the end support side members 63, 64, 67, 68.

When assembled as shown in the drawings, track assembly 50 mount and carries drive assembly 40, carriage assembly 30, and lifting assembly 10. Consequently, that full assembly of subsystems 50, 40, 30 and 10 can be prefabricated and installed as a unit to any suitable supporting structure, including support assembly 60. Moreover, as shown in the drawings, the overhead support 71 and the track assembly 50 are designed so that the track assembly can be detachably mounted to the overhead support. Therefore, the track assembly 50 can be attached to the support assembly 60 after the latter has been installed in a room, and can be removed from the support assembly 60 prior to the support assembly being disassembled. Furthermore, the length of channels 76 may be made long enough that the overhead support 71, with the track assembly 50 attached thereto, could be set down on a flat surface and supported by the lower ends of the channels 76 with the drive assembly 40, the carriage assembly 30 and the lifting assembly 10 clearing the flat surface.

A distinct advantage is attained by providing the lifting assembly 10 and its associated track assembly 50, carriage assembly 30 and drive assembly 40 as a separate composite unit. This separate composite unit can be manufactured and assembled using relatively high manufacturing standards and technique for fit and alignment. The overhead support 71 need only provide attachment points for track assembly 50 that will insure safe and stable overhead mounting of the track assembly. The tolerances between the two need not be particularly close and, therefore, relatively lower manufacturing standards and techniques can be employed in the fabrication of the overhead support 71 as well as the end supports 61, 62.

The overhead support side members 72, 73 are provided with steel attachment fittings 77 for attaching the track assembly 50 to the side members. These fittings are designed to enable the track assembly 50 to be quickly and easily attached to and removed from the overhead support 71. Each fitting 77 is attached, as by welding, to the inner face of a side member 72, 73 at the location where an end of a track assembly end bar 53, 54 is to be positioned. The fittings 77 are designed so that the track assembly 50 can be lifted up between the overhead support side members 72, 73 and attached to the fittings 77. Each fitting, as shown in the drawings, comprises a lower first part 77*a* that provides a base tab and a vertical tab that protrude from the side member inner face; and an upper second part 77*b* that provides a vertical tab that also protrudes from the side member inner face vertically above the first part's vertical tab. The fitting base tabs are arranged so that the track assembly end bars 53, 54 can be lifted up and positioned slightly to one side of the fittings 77, and then shifted horizontally onto the fitting base tabs. The fitting vertical tabs are provided with threaded bores that align with bores in the end portions of the end bars 53, 54 so that Line screws can be inserted through the end bars and threaded into the vertical tabs to lock the track assembly 50 securely to the overhead support side members 72, 73. The fitting base tabs are strong enough to support the weight of the fully assembled track assembly 50. The lower first part 77*a* of each fitting 77, comprising a base tab and a vertical tab, may be fabricated from one piece of steel and formed in a L or J configuration. If the lower first part 77*a* is formed in a J configuration, the track assembly end bars 53, 54 would be lifted up and over the hook portion of the J configuration and set down into the J configuration's concavity. Setting in the J configuration concavity, the track assembly 50 would be held in position and adequately supported by the base tab while the track assembly side members are screwed to the vertical tabs. Likewise, the track assembly, during removal from the support assembly 60, would remain adequately supported after removal of the machine screws from the vertical tabs.

The support assembly end support side members 63, 64, 67, 68 may be fabricated in lengths short enough to easily fit through a standard interior doorway. Because it would often be desirable to elevate the track assembly above that standard doorway height, the support assembly overhead support side members 72, 73 are fabricated to provide a horizontal overhead support mid-section 71*a* and two sloped side sections 71*b*, 71*c*. The side member portion in each side section 71*b*, 71*c* is attached at one end to a leg connector channel 76 and extends upward, at an angle that is acute to the horizontal, to the side member portion in the horizontal mid-section 71*a*. This arch-like configuration of the overhead support 71 enables the positioning of the carriage assembly at a higher elevation than would be possible if the side members 72, 73 extended horizontally between the end supports 61, 62.

An electrical or electronic control assembly is provided to control the operation of drive motor 41, acme screw drive motor 49, and winch 14 in response to various actuation and control signals. A controller 80 is provided to receive various signals and to issue various control signals as required to operate the system. The controller 80 is designed to be connected to an appropriate external power source, such as 110/115 or 220 volt AC. Controller 80 is electrically connected to drive motor 41, acme screw drive motor 49, and winch 14 to supply power to operate them. Controller 80 is electrically connected to travel limit switches 81, mounted to overhead support side member 72, to cut-off power to acme screw drive motor 49 when one of the limit switches 81 is tripped. Limit switch trippers 38 are mounted at appropriate locations on rail mount mounting plate 35 so that the extent of longitudinal travel of the carriage assembly 30 along the track assembly 50 will be limited to distances between the limit switches 81.

The controller is also electrically connected to winch 14 through a rotary connector 82 is mounted atop drive assembly drive shaft 42. Connector 82 transfers power from an external static power line coming from controller 80, through a rotary power transfer connection, into a power line within drive shaft 42. The power line within drive shaft 42 extends through drive shaft 42 and connects to winch 14 so that power is supplied to winch 42 without danger of power line twisting as winch 14 rotates about vertical axis 13. Controller 80 is also coupled to an operator module 83, such as by power/signal line 84, so that an operator can signal controller 80 to operate drive motor 41 and winch 14. Controller 80 could be coupled to operator module 83 for infra-red or microwave signalling, instead of the direct electrical connection of line 84; the configuration of controller 80 and operator module 83 as to how they communicate being a matter of choice. Module 83 includes control buttons to operate drive motor 41 in clockwise and counterclockwise directions so that the lifting arm 12 can be pivoted in either direction. Module 83 includes control buttons to operate acme screw drive motor 49 in clockwise and counterclockwise directions so that the carriage assembly could be moved along the track assembly 50 in forward and rearward directions. Module 83 also includes control buttons to operate winch 14 to raise and lower the lifting cable 16.

The control assembly includes a power cut-off control 83 located on winch 14 that is electrically coupled to the motor of winch 14 and to a cable limit sensor assembly 90. The winch lifting cable 16 will carry some form of travel limiter 17 that can engage a spring-biased target lever 91. Limiter 17 would typically be located just above the lifting cable connector 22, or could alternately be provided as part of connector 22 or as the link that joins connector 22 to the outer end of lifting cable 16. Lever 91 is pivotally mounted at the end of lifting arm 12 by a mounting bracket 92 that is attached to the lifting arm fairlead 20. When limiter 17 contacts lever 91, as the lifting cable 16 is substantially fully retracted, slight further retraction of cable 16 will cause lever 91 to pivot from the condition shown in FIG. 5 to the position shown in FIG. 6. Lever 91 carries a target 93 positioned to be carried past sensor 94 when lever 92 is pivoted to the position shown in FIG. 6. When sensor 94 detects the FIG. 6 position of target 93, control 83 will cut off power to winch 14 to prevent further retraction of the lifting cable 16. Sensor 94 is coupled to control 83 by a signal line 95 that extends along lifting arm 12. When the lifting cable 16 is lowered so that limiter 17 clears the lever 91, coil spring 96 will pivot lever 91 back to the FIG. 5 position. Control 83 will permit the winch to pay the lifting cable 16 out to release lever 91, but it will not permit the winch to reel the lifting cable in until lever 91 returns to its FIG. 5 position.

Various auxiliary devices can be supported by the system. As shown in the Figures, a privacy curtain 100 can be hung on rods 101 that are carried by the support assembly side members. Appropriate rods or hooks, or other medical support devices, can be attached to the support assembly, as can lighting arrays, TV shelves, and so forth. The end of lifting arm 12 is preferably provided with a cross-rod 102 from which a hand grip 103 can be suspended for use by a patient to lift and steady himself during use of the system.

VEST AND LEG ASSEMBLY

The vest assembly 120 is designed to fit around a patient's torso so that a patient, wearing the vest assembly, can be lifted by connecting the lifting cable connector 22 to the vest assembly as shown in FIG. 1. The vest assembly comprises a rectangular, elongated flexible vest 121 designed to fit around the back of a person and buckle in front. Several longitudinal straps are 122 are secured to the outside of vest 121 with one end of each strap connected to one half of a quick release buckle 123 and with the other end of each strap adjustably connected to the other half of a quick release buckle 123. The vest may be provided with a pair of extensions 124 located to fold under a person's arms to protect the person's upper arms from chaffing against the vest 121. The vest is preferably lined with a cushion material 125, such as sheepskin or fleece. The vest 121 may be fabricated from a strong nylon material and the straps 122 may be fabricated from nylon webbing material.

The straps 122 serve to strengthen the vest 121 and also serve as anchor points for several lifting cable attachment rings, such as D-rings 126. D-rings 126 are located in a transverse line across the mid-line of the vest 121 so as to be located adjacent a person's backbone when the vest is worn, as shown in FIG. 1. These several D-rings 126 provide several in-line lifting points to which the lifting cable connector 22 can be selectively attached to lift a person upward. Through practice and experience, an appropriate lifting point can be determined to lift a given patient, depending on the type of lifting required and the anatomy of the patient. The D-rings 126 are stitched between the outer surface of the vest 121 and the inner surfaces of the straps 122 with the D-ring linear bases oriented parallel to the longitudinal straps 122.

Between the line of D-rings 126 and the ends of the vest 121, a pair of lifting straps 127 are stitched to the vest, underneath the longitudinally extending straps 122. The lifting straps 127 are located and configured to provide lifting loops close to but on either side of a person's breast bone, over the person's rib cage. As thusly located, an attendant can grip the loops of the lifting straps 127, while bending over a patient, if the patient is reclining, or while standing in front of a patient, if the patient is sitting, and lift or turn the patient. Pairs of anchor points in the form of D-rings 128, 129 are provided near the bottom and top edges of each end of the vest 121. The top pair of D-rings 129 providing additional lifting points to which the lifting cable connector 22 might be attached. The bottom pair of D-rings 128 provide connecting points for attachment to the leg assembly 150, either directly or through a cross-connecting cable link 130.

The leg assembly 150 is designed to fit over a patient's feet and lower legs to assist the patient in being lifted and transferred into and out of a chair, such as a wheel chair or a portable commode. It is designed to be used in conjunction with the vest assembly 120. The leg assembly 150 comprises a foot platform 151, a pair of leg supports 152, 153 longitudinally joined at their inner edges by a divider 154, and a connecting link 165 extending from the back of the foot platform 151 to an upper portion of divider 154.

The leg supports 152, 153 are designed and configured to allow a patient's feet to slip onto the foot platform 151 so that the lower portion of the leg supports extends over the patient's feet. The leg supports 152, 153 are also designed and configured to allow a patient's lower legs to bear against the inside of the leg supports so that the full front areas of the lower legs can be supported. The leg supports 152, 153 are concave facing toward the patient's legs. The leg supports 152, 153 provide rigid concave shells 155, 156 that are encased in pockets provided therefor in a covering 157. The inner side of the covering 157 is provided with a cushioned lining 158 such as sheepskin or fleece to protect the patient's forelegs and arches. The covering 157 is joined to the foot platform 151 by flexible arch straps 159, 160 that permit the patient's feet to slip between the foot platform 151 and the arch portion of the leg supports 152, 153. The divider 154 provides a rigid elongated stiffener 161 that is encased in a pocket provided therefore in covering 157.

The covering 157 is fabricated from a strong fabric such as nylon. The covering 157 may be provided with a pair of zippers 162, 163 along the inner sides of the leg support pockets so that the rigid shells 155, 156 may be removed so that the covering might be cleaned. The top of the stiffener pocket may be closed by a Velcro hook and loop closure configuration 164 so that the stiffener 161 may also be removed when the covering 157 is to be cleaned.

The connecting link 165 comprises an adjustable strap 166 that is pivotally connected to the rear of the foot platform 151 opposite the divider 154 by a removable clip 167. Strap 166 is also connected to a D-ring 168 by a swivel connector and carabinier clip 169. D-ring 168 is sewn to the covering 157 at the back side of the pocket for the stiffener 161.

A pair of closure straps 170, 171 are provided to secure a patient's legs into the leg assembly 150. The straps are stitched to one side of the covering 157 at an outside edge of leg support 153 and are designed to be drawn behind patient's calves and wrapped around the opposite leg support 152 and fastened to the covering 157 at the opposite leg support 152. The straps 170, 171 and covering 157 are provided with Velcro loop and pile closures so that the straps can be easily applied and removed.

A connecting cord 172 detachably connects the leg support D-ring 168 to the vest assembly cross-connecting cable link 130. A clip 173 detachable joins cord 172 to D-ring 168. A similar clip joins the upper end of cord 172 to cable link 130.

USE OF THE SYSTEM

The configuration of the support assembly 60 and the track assembly 50 shown in the drawings would be especially advantageous where the system is intended to be installed in a patient's room at home for a short duration and then removed and installed in another patient's room at home. For example, elderly stroke victims who are partially disabled can be cared for at home with the installation of the system of this invention. Typically, however, an elderly stroke victim may not live longer than several months following the stroke. The configuration of the system as described herein, would permit the system to be bought and owned by a medical equipment rental facility and rented out to the patient's family for the relatively short time that the system would be needed. When the need of the system has ceased, the system could be removed and rented to another patient's family. Because the configuration of the system allows the structurally components to be easily assembled, disassembled and relocated, a home care option can be provided for a patient and his or her family that was heretofore not available. And even for long term uses, the cost of renting the system, or of even outright purchase of the equipment by the patient or the patient's family, would be substantially less than the cost of nursing home treatment, and also could be more emotionally beneficial to the patient and his or her family.

The vest assembly 120 may be worn by a patient while reclining. Many elderly patients tend to find rooms chilly and being able to wear the lined vest 121 may help such a patient feel more comfortable. The back bone D-rings 126 are designed to lay flat against the vest 121 so that a patient may recline without being discomfited by the present of these D-rings, and the vest lining 125 helps cushion the reclining patient's back area. With the vest on, a reclining patient can be raised upward to lift his or her waist and buttocks off the bed by attaching the lifting cable connector 22 to one of the front-oriented D-rings 128, 129. This would enable an attendant to straighten the bed covers underneath the patient without having to roll the patient about. With the vest on, a reclining patient can be raised upward into a sitting position by attaching the lifting cable connector 22 to one of the upper front edge D-rings 129 and retracting the lifting cable 16 so as to pull the patient into an upright position. Once in an upright position, a patient could grip the hand grip 103 to steady himself or herself and further retract the lifting cable 16 to slightly raise himself or herself off the bed so that, with the aid of hand grip 103, the patient could maneuver his or her legs over the side of the bed into a sitting position. By shifting the location of the lifting arm 12, either by moving the carriage assembly 30 or by rotating the lifting arm 12 about the axis 13, or both, the lifting cable 16 can be appropriately oriented to directionally pull and lift the patient in whatever direction is desired.

A short length of strap (not shown) could be attached to one of the back bone D-rings 126 so that a patient could reach over his or her shoulder and grasp the short length, pull that short length over his or her shoulder, and then attach the short length to the lifting cable connector 22. The provision of the short length of strap provides an extension that would enable a patient to attach or detach himself or herself to the lifting cable without assistance. When reclining in bed, the extension strap could be left laying across the patient's chest, for example, where the patient could easily reach it and attach it to the lifting cable connector 22.

One of the problems that an attendant experiences in moving an immobile patient from a bed to a wheelchair or to a portable commode is the difficulty in shifting the patient from a sitting position on the bed into the wheelchair or commode, and vice versa. Typically, when unaided, the attendant must grasp the patient and lift him or her up to raise his or her buttocks from the bed and then swivel the patient around and down into the wheelchair or commode. During the process of swiveling the patient, the patient's legs typically hang down limply and the swiveling action can place an undue strain on the patients knees and hips. It is not uncommon for these patients to experience injured knees and hips as a result. Moreover, while merely raising the patient up by use of the vest assembly 120 of this invention and then rotating the patient while he or she is suspended by lifting cable 16 can simplify patient transfer and eliminate the risk of injuring the patient's knees or hips, the full weight of the patient must be born by the patient's rib cage and arm pits as his or her chest is carried in the vest assembly. This situation is very uncomfortable for the patient and may risk injuring the patient's rib cage and shoulders.

The provision os the leg assembly 150 is designed to eliminate the risk of injury to a patient during the transfer operation discussed in the preceding paragraph. When the patient's legs and feet are inserted into the leg assembly and strapped therein by straps 170, 171, the leg assembly and the vest assembly would be connected together by connecting cord 172, with the connecting cord extending up between the patient's thighs. As thus connected, with connecting cord 172 extending from the connecting link 130 on the bottom front of the vest assembly 120 to the D-ring 168 at the top of the leg assembly 150, the lifting force is transferred from lifting cable 16 through the vest 121 to the leg assembly D-ring 168. The leg assembly 150 stabilizes the position of the patient's legs and feet and serves a function somewhat similar to a splint. Therefore, when a patient is lifted to a position such as shown in FIG. 1, either by himself or by an attendant, a significant portion of the patient's weight is born by his or her legs and feet.

As the patient is lifted upward, the line of force will tend to be vertical from point on the back of the vest at which the lifting cable 16 is attached, through the bottom front vest connection of connecting cord 172 to the leg assembly D-ring 168. The patient's torso is supported by the vest assembly 120 and the patients legs and hips are supported by the leg assembly 150. The length of connecting cord 172 is adjusted so that the patient will be retained in the vest assembly and in the leg assembly in a partially upright position, the patient appearing as in FIG. 1 to be partially hunched over. Consequently, the patient's legs will be inclined forward so that his or her knees will be positioned over his or her arches. The length of leg assembly strap 166 is adjusted so that the foot platform 151 can tilt downward from the heel end to the toe end under the weight of the patient. This tends to firmly seat the patient's legs and feet into the leg assembly 150 and also unweights the patient's heels. Therefore, when an attendant adjusts the height of the patient so that the toe of the foot platform 151 just barely touches the floor, the attendant can easily swivel the patient about the foot platform through any degree of rotation without placing twisting strain on the patient's knees or hips. To make it easier to swivel the foot platform 151, the toe portion of the foot platform can be tapered at 151*a* and 151*b* so that the front part 151*c* of the toe portion is reduced in width.

The leg assembly arch straps 159, 160 flexibly connect the covering 157 to the foot platform 151. Therefore, when the leg assembly 150 is applied to a patient's legs, the foot platform will be placed flat on the floor while the patient's feet are inserted between the concave shells 155, 156 and the foot platform 151. When the patient is lifted, the flexible connection of the arch straps 159, 160 will permit the patient's feet to incline downward from their heels to the position shown in FIG. 18, the downward slope being determined by the length of connecting link 165. Likewise, when the patient is seated in a wheelchair or portable commode, the upward pull of connecting cord 172 will be relaxed and the weight of the patient's legs and feet will cause the foot platform 151 to lower to the floor.

A patient who is paralyzed from the waist down, but whose upper body is not paralyzed, could operate the system to move him or her self out of bed and into a wheelchair or portable commode with much less strain and trouble. Such a patient could actuate the system through hand control module 83 to bring the hand grip 103 into range so that he or she could grasp the hand grip and pull him or her self upright. He or she could then attach the lifting cable 16 to the back of the vest 121, such as by using the previously mentioned extension cord already attached to one of the backbone D-rings and raise him or her self from the bed so that he or she could position his or her legs over the side of the bed. Then, he or she could apply the leg assembly 150 to his or her legs, fastening straps 170, 171 about his or her calves and fastening connecting cord 172 to the vest connecting link 130. Then, the patient could position the lifting arm 12 and operate the winch 14 so that he or she would be lifted and pivoted from the bed to a point alongside a wheelchair, as shown in FIG. 1. The carriage assembly 30 could then be moved and the winch 14 operated to move the patient's buttocks toward the wheelchair and to lower the patient into the wheelchair. By operating the carriage assembly screw drive motor 49, the lifting arm rotation motor 41, and the winch 14 the lifting arm fairlead 20 can be positioned anywhere that the patient requires and the patient can be raised or lowered as needed to accomplish the desired task.

The foregoing operation, described as through the patient were effecting the necessary actions, can be just as conveniently be accomplished by an attendant. In either case, whether the patient or an attendant is operating the system, the design and placement of the vest assembly 120 and the leg assembly 150 leaves the patient's waist and buttocks free from confinement. Therefore, either the patient or the attendant can conveniently lower the patient's garments so that the patient can urinate or defecate. This feature of the leg and vest assemblies is particularly important to making the system user-friendly. A stroke victim, for example, often cannot control his or her bladder or bowels very well. Therefore, when that patient signals his or her attendant of the need to relieve him or her self, there is not much time available to move the patient from the bed and into a portable commode. With the present system, an attendant, even an elderly attendant—such as the stroke victim's spouse, can move the patient from the bed and into the portable commode in sufficient time to avoid having the bedding soiled.

In some applications the lifting assembly 10 may not be required to move longitudinally and, in such applications, the track assembly 50 may not be required. Typical of such applications would involve a requirement for lifting and transferring a patient from one pre-established position to another pre-established position. An example of this would be the requirement for lifting a patient from a wheelchair into a bath tub, where the wheel chair could be positioned in a pre-established position so that the lifting arm 12 could be rotated to position the lifting cable 16 over the wheelchair. In this example, the patient could be lifted from the wheelchair by reeling the cable in onto cable reel 15, the lifting arm 121 could then be rotated to transfer the patient over the bath tub, and then the cable could be reeled out to lower the patient into the bath tub. In such an application, the reach of the lifting arm 12 could be designed to project far enough so that the platform 31 could be statically mounted to a wall of the bath tub enclosure. Thus, for example, by mounting the platform 31 on an end wall of the bath tub enclosure, so that the lifting arm could project over the bath tub, a patient in a wheelchair, or an attendant, could position the wheel chair alongside the bath tub, position the lifting arm 12 so that the lifting cable hung over the patient, engage the lifting cable 16 to the patient, lift the patient free of the wheelchair and rotate the lifting arm 12 until the patient was position over the bath tub, and lower the patient into the bath tub. For such applications, the platform 31 would not require rail mounts or rail mount mounting plates, such as elements 33, 34, 35 and 36. However, the platform 31 would require an appropriate wall mounting plate and associated wall mounting bracket so that the platform could be securely attached to the wall. Moreover, the physical configuration of platform 31 might be changed for wall-mounting, however the functional requirement of rotatably mounting the lifting assembly 10 would remain.

While the preferred embodiment of the invention has been described herein, variations in the design may be made. The scope of the invention, therefore, is only to be limited by the claims appended hereto.

The embodiments of the invention in which an exclusive property is claimed are defined as follows.

I claim:

1. A lifting and transferring system for lifting a person and transferring the person from one location to another location, the system comprising:

a) a lifting and transferring assembly comprising a lifting arm assembly and an overhead support, said lifting arm assembly providing a lifting arm rotatable below said support about a vertical axis; mounting means rotatably mounting said lifting arm to said support so that said lifting arm is suspended below said support and cantilevers outward from an inner end at said mounting means to an outer end; an extendable and retractable lifting cable depending from the outer end of said lifting arm and extending along said lifting arm to a cable reel adjacent the inner end of said lifting arm; first motor means for rotating said lifting arm, said first motor means including a first motor carried by said mounting means above said lifting arm assembly; second motor means for extending and retracting said lifting cable, said second motor means including said cable reel and a second motor carried by said mounting means below said support for rotation with said lifting arm, said cable drum being coupled to said second motor for extending and retracting said lifting cable; and a controller to operate said first and second motor means;

b) transfer apparatus connectable to said lifting cable and arranged to support the person during operation of said lifting and transferring assembly.

2. The system of claim 1 wherein said transfer apparatus comprises a vest fittable around the person's torso and detachably connectable to said lifting cable.

3. The system of claim 1 wherein said lifting arm assembly includes a cable fairlead provided at the end of said lifting arm through which said lifting cable extends, and wherein said lifting arm assembly includes a cable limit sensor means connected to said fairlead so as to be kept in close alignment with said lifting cable and operatively associated with said controller to prevent said lifting cable from retracting beyond a predetermined limit.

4. A lifting and transferring system for lifting a person and transferring the person from one location to another location, the system comprising:

a) a lifting and transferring assembly comprising a lifting arm assembly and a support, said lifting arm assembly providing a lifting arm rotatable about a vertical axis; mounting meads rotatably mounting said lifting arm to said support so that said lifting arm cantilevers from said mounting means: an extendable and retractable lifting cable depending from an outer end of said lifting arm; first motor means for rotating said lifting arm; second motor means for extending and retracting said lifting cable: and a controller to operate said first and second motor means; and said lifting and transferring assembly including a third motor means for moving said lifting arm forwardly and rearwardly along a longitudinal course under the control of said controller; and b), transfer apparatus connectable to said lifting cable and arranged to support the person during operation of said lifting and transferring assembly.

5. The system of claim 4 wherein said mounting means comprises a track assembly carried by said support, and a carriage assembly moveable along said track assembly on said longitudinally course, said lifting arm, said second and third motor means being carried by said carriage assembly, and said first motor means being carried by said lifting arm assembly.

6. The system of claim 5 wherein said transfer means comprises a vest fittable around the person's torso and detachably connectable to said lifting cable.

7. The system of claim 6 wherein said transfer means further comprises a foot and leg support fittable around the person's lower legs and detachably connectable to said vest.

8. The system of claim 5 wherein said transfer apparatus comprises a vest fittable around the person's torso and detachably connectable to said lifting cable.

9. The system of claim 5 wherein said lifting arm assembly includes a cable fairlead provided at the end of said lifting arm through which said lifting cable extends, and wherein said lifting arm assembly includes a cable limit sensor means connected to said fairlead so as to be kept in close alignment with said lifting cable and operatively associated with said controller to prevent said lifting cable from retracting beyond a predetermined limit.

10. A lifting and transferring system for lifting a person and transferring the person from one location to another location, the system comprising:

a) a lifting and transferring assembly comprising a lifting arm assembly and a support, said lifting arm assembly providing a lifting arm rotatable about a vertical axis; mounting means rotatably mounting said lifting arm to said support so that said lifting arm cantilevers from said mounting means; an extendable and retractable lifting cable depending from an outer end of said lifting arm; first motor means for rotating said lifting arm; second motor means for extending and retracting said lifting cable; and a controller to operate said first and second motor means;

b) transfer means connectable to said lifting cable and arranged to support the person during operation of said lifting and transferring assembly; said transfer means comprising a vest fittable around the person's torso and detachably connectable to said lifting cable and said transfer means further comprising a foot and leg support fittable around the person's lower legs and beneath the persons feet, the foot and leg support being detachably connectable to said vest.

11. The system of claim 10 wherein a back portion of said vest has a first fitting for attachment to said lifting cable, and wherein a front portion of said vest has a second fitting for attachment to said foot and leg support.

12. The system of claim 11 wherein said transfer means includes a connector extendable between said foot and leg support and said vest and connectable to said second fitting and to said foot and leg support so that said foot and leg support will be lifted by said vest when said vest is lifted by said lifting cable.

13. A lifting and transferring system for lifting a person and transferring the person from one location to another location, the system comprising:

a) a lifting and transferring assembly comprising a cable deploying assembly and a support, said cable deploying assembly providing an extendable and retractable lifting cable; mounting means mounting said cable deploying assembly to said support; motor means for extending and retracting said lifting cable; and a controller to operate said motor means;

b) transfer means connectable to said lifting cable and arranged to support the person during operation of said lifting and transferring assembly comprising a vest fittable around the person's torso and detachably connectable to said lifting cable; said vest having a generally rectangular form designed to fit around the person and to be fastened in front, and including a plurality of lifting cable attachment devices located in a transverse line across a mid line of the vest so as to be located adjacent the person's backbone when the vest is worn whereby the lifting cable may be fastened to any one of the devices so that the point at which the person is lifted may be adjusted depending on the type of lifting required and the anatomy of the person.

14. A lifting and transferring system for lifting a person and transferring the person from one location to another location, the system comprising:

a) a lifting and transferring assembly comprising a cable deploying assembly and a support, said cable deploying assembly providing an extendable and retractable lifting cable; mounting means mounting said cable deploying assembly to said support; motor means for extending and retracting said lifting cable; and a controller to operate said motor means;

b) transfer means connectable to said lifting cable and arranged to support the person during operation of said lifting and transferring assembly comprising a vest fittable around the person's torso and detachably connectable to said lifting cable; said transfer means further comprising a foot and leg support fittable around the person's lower legs and beneath the persons feet, the foot and leg support being detachably connectable to said vest.

15. The system of claim 14 wherein a back portion of said vest has a first fitting for attachment to said lifting cable, and wherein a front portion of said vest has a second fitting for attachment to said foot and leg support.

16. The system of claim 15 wherein said transfer means includes a connector extendable between said foot and leg support and said vest and connectable to said second fitting and to said foot and leg support so that said foot and leg support will be lifted by said vest when said vest is lifted by said lifting cable.

17. A transfer means connectable to lifting apparatus for lifting a person and transferring the person from location to another which comprises a vest fittable around the person's torso and detachably connectable to the lifting apparatus, and a foot and leg support fittable around the person's lower legs and beneath the persons feet, the foot and leg support being detachably connectable to said vest.

18. The system of claim 17 wherein a back portion of said vest has a first fitting for attachment to the lifting apparatus, and wherein a front portion of said vest has a second fitting for attachment to said foot and leg support.

19. The system of claim 18 wherein said transfer means includes a connector extendable between said foot and leg support and said vest and connectable to said second fitting and to said foot and leg support so that said foot and leg support will be lifted by said vest when said vest is lifted by the lifting apparatus.

* * * * *